United States Patent [19]

Ueno et al.

[11] 4,166,509

[45] Sep. 4, 1979

[54] PROCESS FOR EXCAVATING AND CONSTRUCTING TUNNEL AND EXCAVATING DEVICE

[75] Inventors: Toshiyuki Ueno, Funabashi; Isamu Itoh, Tokyo; Yasuyuki Morita, Mitaka, all of Japan

[73] Assignee: Japanese National Railways, Tokyo, Japan

[21] Appl. No.: 922,324

[22] Filed: Jul. 6, 1978

Related U.S. Application Data

[62] Division of Ser. No. 824,614, Aug. 15, 1977.

[51] Int. Cl.[2] ..... E21D 9/04

[52] U.S. Cl. ..... 175/94; 405/139; 173/43; 175/106

[58] Field of Search ..... 405/132, 138–143; 173/43, 44; 175/77, 78, 62, 94, 106

[56] References Cited

U.S. PATENT DOCUMENTS

| | | | |
|---|---|---|---|
| 7,972 | 3/1851 | Fowle | 173/43 |
| 498,721 | 5/1893 | McKay | 173/43 |
| 958,952 | 5/1910 | Bennett | 173/43 X |
| 1,113,531 | 10/1914 | Ball et al. | 173/43 X |
| 1,310,274 | 7/1919 | Branning | 173/43 |
| 4,009,579 | 3/1977 | Patzner | 405/138 |

*Primary Examiner*—Dennis L. Taylor
*Attorney, Agent, or Firm*—Lane, Aitken & Ziems

[57] ABSTRACT

A process for excavating and constructing a tunnel, and an excavating device are disclosed. This process is directed to excavating and constructing a tunnel under a railway or a road on a banking or on level land in the direction transverse to the railway or road. In this process, pits are dug on the opposite sides of the railway, and then an excavator digs into the wall of a pit on one side so as to go out of the wall of the other pit through the ground left therebetween. In this respect, a hollow casing unit of a box shape is coupled to the rear end of the excavator equipped with a screw conveyor. As the excavator advances or digs forwards a given distance, another casing unit is in turn coupled to the rear end of the preceding casing unit, and then such a step is repeated, until the excavator goes out of the wall of another pit. In this manner, the excavator further digs into the wall of one pit in the position adjacent to the preceding run of casing units. Then, these runs of casing units are placed around the imaginary contour of a tunnel, thereby forming the outer wall of the tunnel. The sand and soil inside the outer wall of the tunnel is excavated and removed, after which reinforcing steel bars and a mold are placed along the inner surface of the wall of the tunnel. Concrete is then poured into the hollow casing units themselves as well as between the mold and the wall. Thus, the hollow casing units form an integral part of the wall of a tunnel, as an outer wall.

4 Claims, 16 Drawing Figures

PROCESS FOR EXCAVATING AND CONSTRUCTING TUNNEL AND EXCAVATING DEVICE

This is a division, of application Ser. No. 824,614, filed Aug. 15, 1977.

BACKGROUND OF THE INVENTION (1) Field of the Invention

This invention relates to a process for excavating and constructing a tunnel and an excavating device therefor, and more particularly to a process for constructing a tunnel under a railway or road in the direction transverse thereto.

(2) Description of the Prior Art

Hithereto, for excavating a tunnel under a railway, road or a building in the direction transverse thereto, several attempts are known, such as a shielding process or a process, in which steel pipes are driven into the ground above a tunnel or along the upper-arcuate portion of the tunnel in the longitudinal direction of the tunnel, and then soil or sand therein are excavated by towing an excavator, after which a tunnel is constructed internally of the cavity thus formed. However, the former attempt suffers from disadvantages of an excessively large scale excavating device and an expenditure of much time and efforts for placing segments after the excavation, and the like. The latter attempt, on the other hand, poses problems that considerable long steel pipes should be driven at a considerable depth under the surface of the ground in the horizontal direction, and as a result a large area is required for constructing of the tunnel. In addition, difficulties are encountered with driving steel pipes into the ground in precisely side-by-side relation along predetermined paths. Furthermore, when an excarator is towed through the ground encompassed with steel pipes driven, the excavator does not happen to leave an ample thickness of soil between the top row of steel pipes and the excavator, thus presenting a danger of ground subsidence.

SUMMARY OF THE INVENTION

It is an object of the present invention to provide a process for excavating and constructing a tunnel, which avoids the aforesaid shortcomings experienced with the prior art process of the type described, and which alows simple excavating and constructing operations with desired accuracy and may reinforce the tunnel constructed.

It is another object of the present invention to provide an excavator or excavating device, which is simple in construction and small in size, but allows excavation for a considerable length of a tunnel.

According to the present invention, there is provided a process for excavating and constructing a runnel which comprises the steps of digging pits in the opposite sides of a railway or a road, respectively; allowing an excavator to dig into the wall of a pit one side so as to go out of the wall of the other pit through the ground left therebetween, with a hollow casing unit of a box shape being coupled to the rear end of the excavator having a screw conveyor, and then the succeeding casing unit to the rear end of the preceding casing unit; repeating the above steps for forming another run of casing units adjacent to the first run of casing units, thereby forming an outer wall of a tunnel, which wall consists of casing units; removing soil and sand inside the outer wall of the tunnel; placing reinforcing steel bars and a mold along the inner surface of the outer wall of the tunnel, after which concrete is poured into the outer wall or casing units and between the outer wall and the mold thus completing the construction of the tunnel.

In addition, there is provided an excavating device for use in this process, which comprises: a pair of screw rods positioned on the opposite sides of one of pits provided on the longitudinally opposite sides of a tunnel to be constructed; a pair of internally threaded cylinders fitted on the screw rods in a movable manner up and down; a platform supporting beam secured to the cylinders in a manner to span the both cylinders; a rotary-disc-retaining body mounted on the supporting beam in its center; a rotary disc secured to the end of the platform and fitted in the rotary-disc-retaining body; a worm wheel secured to a rotary shaft which is secured to the center of the rotary disc; a worm gear meshing with a worm wheel and driven by means of a motor, so that the rotary disc may be rotated both clockwise and counterclockwise; a motor provided for an excavator, and mounted on the platform in a movable manner in the longitudinal direction of the tunnel, along with a screw conveyor, the excavator being secured to the tip of the screw conveyor; a winding drum adapted to move the motor, and associated with a rotary shaft of the motor, whereby the winding drum and the motor may be propelled as the excavating operation proceeds by means of a wire which connects the drum to the motor.

DESCRIPTION OF THE PREFERRED EMBODIMENT

Figure 1:
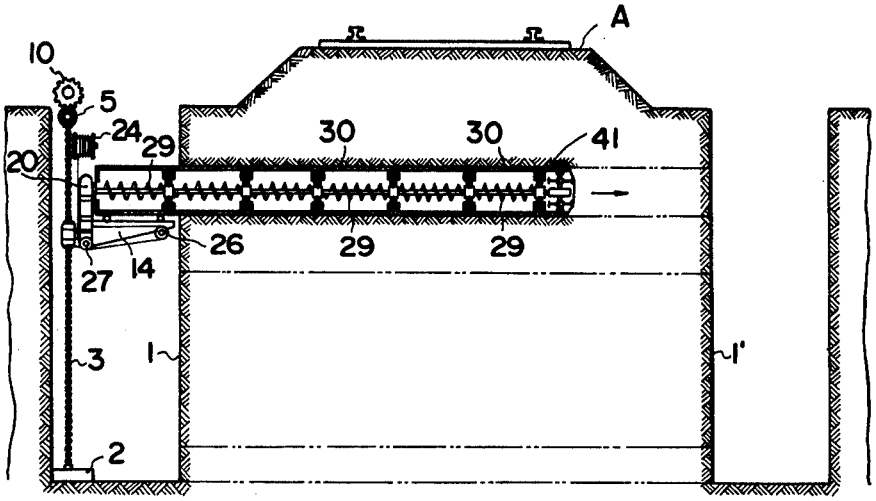
FIG. 1 is a longitudinal cross-sectional view of a tunnel to be constructed, illustrating the excavating operation according to one embodiment of the invention.

Referring to FIGS. 8 to 12, there are shown casing units 30, each of which is formed into a hollow box shape corresponding, for instance, to one of imaginary segments of the ceiling of a tunnel, which are divided in the circumferential and axial directions of a tunnel.

Partition walls 31, 31' having a plurality of holes are provided interiorly of the casing unit 30 at a given spacing in the longitudinal direction thereof, thereby defining a space 32 positioned in the center and extending through the casing unit longitudinally. Holes 33', through which fastening means are to be inserted for the lateral coupling of the casing units, are provided at a given spacing in a side wall 33 of the casing unit 30 on one side, while a slit 34', through which fastening means is to be inserted, is provided in a side wall 34 of the casing unit 30 on the other side, the slit 34' extending through the casing unit 30 longitudinally. A reinforcing plate 35 is provided inwards of the side wall 34 in the casing unit 30 but in the longitudinal direction, while holes 35', through which fastening means are to be connected, are provided in the reinforcing plate 35 in the positions corresponding to the holes 33' provided in the side wall 33. In addition, a plurality of holes 36 are provided in the bottom wall of the casing unit 30. Bolt holes 39, 39', 40, 40', through which longitudinally adjoining casing units are coupled together, are provided in the end plates 37, 37', 38, 38' on the opposite sides of the space 32 extending through the center portion of the casing unit longitudinally.

Figure 13:
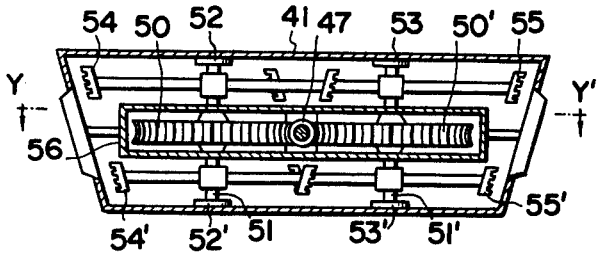
FIG. 13 is a front view of an excavator.
Figure 14:
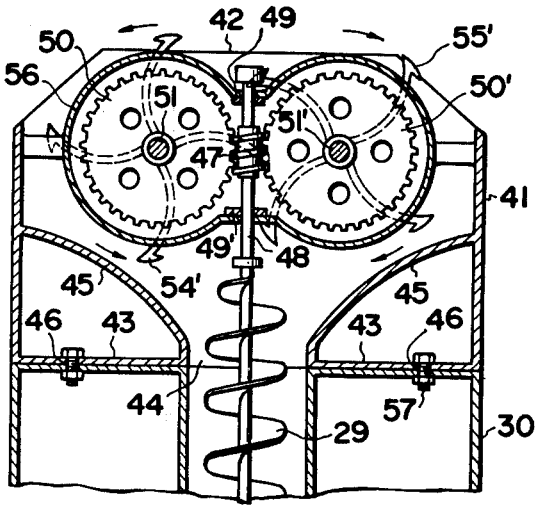
FIG. 14 is a cross-sectional view taken along the line Y—Y' of FIG. 13.

FIGS. 13 and 14 show an excavator. The outer contour of an excavator body 41 is formed into a shape which conforms to the shape of divided imaginary wall of a tunnel, for instance, the shape of one of the aforesaid casing units 30. The front and rear walls of the excavator are not closed. Excavating edge 42 is provided in the front portion of the excavator. An opening 44 is provided in a rear end plate 43 of the body 41 in its center, while walls 45 extend in a diverging manner from the opening 44 forwards. Bolt holes 46 are provided in the opposithe side-portions of the end plate 43 for the connection with the casing unit 30. A screw conveyor 29 extends through the opening 44. A shaft 48 is positioned in the center of the body 41 and a worm gear 47 is secured to the shaft 48 which is journaled in bearings 49, 49' positioned in an axially spaced relation. The screw conveyor 29 is secured to the rear end of the shaft 48. Worm wheels 50, 50' are positioned on the opposite sides of the worm gear 47 in meshing relation. Shafts 51, 51' for the worm wheels 50, 50' are supported by upper and lower walls of the body 41 therebetween, and journaled in bearings 52, 52', 53, 53' respectively. Cutters or blades 54, 54', 55, 55' are secured to the shafts 51, 51' on the opposite sides of the worm wheels 50, 50'. Worm gears 47, and worm wheels 50, 50' are encompassed with a casing 56.

Figure 15:
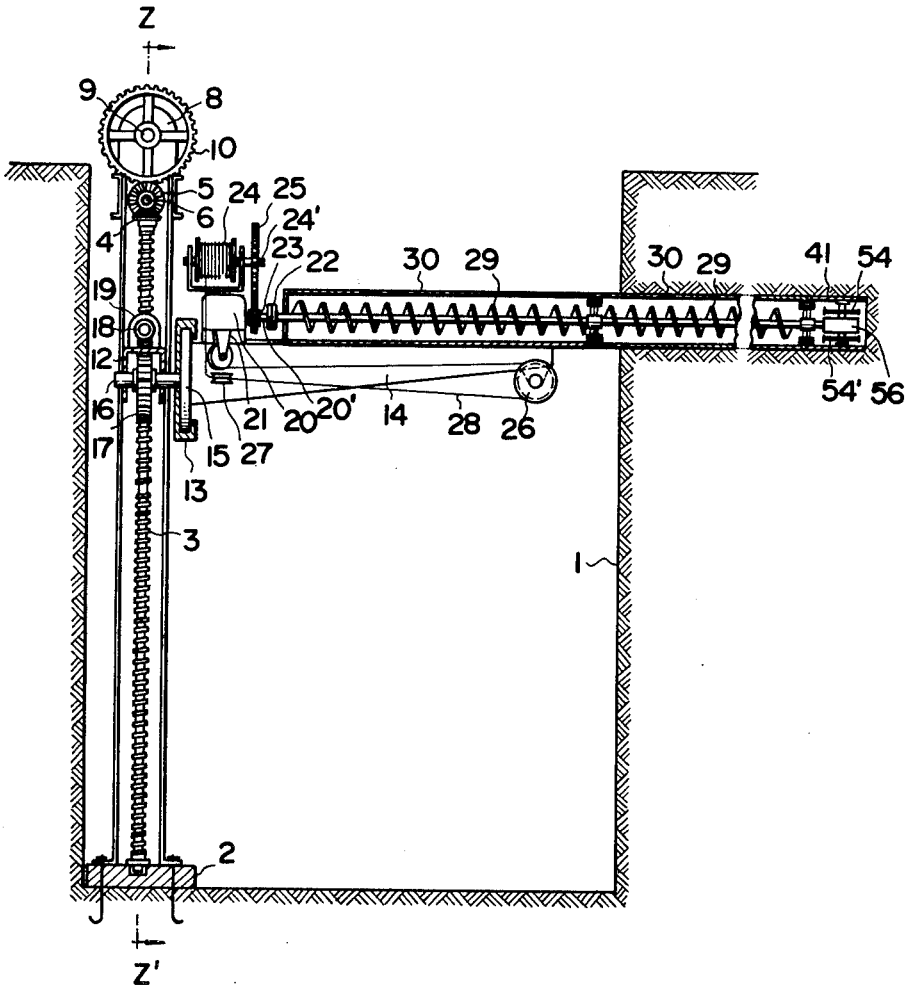
FIG. 15 is a longitudinal, cross-sectional view of an excavating device.
Figure 16:
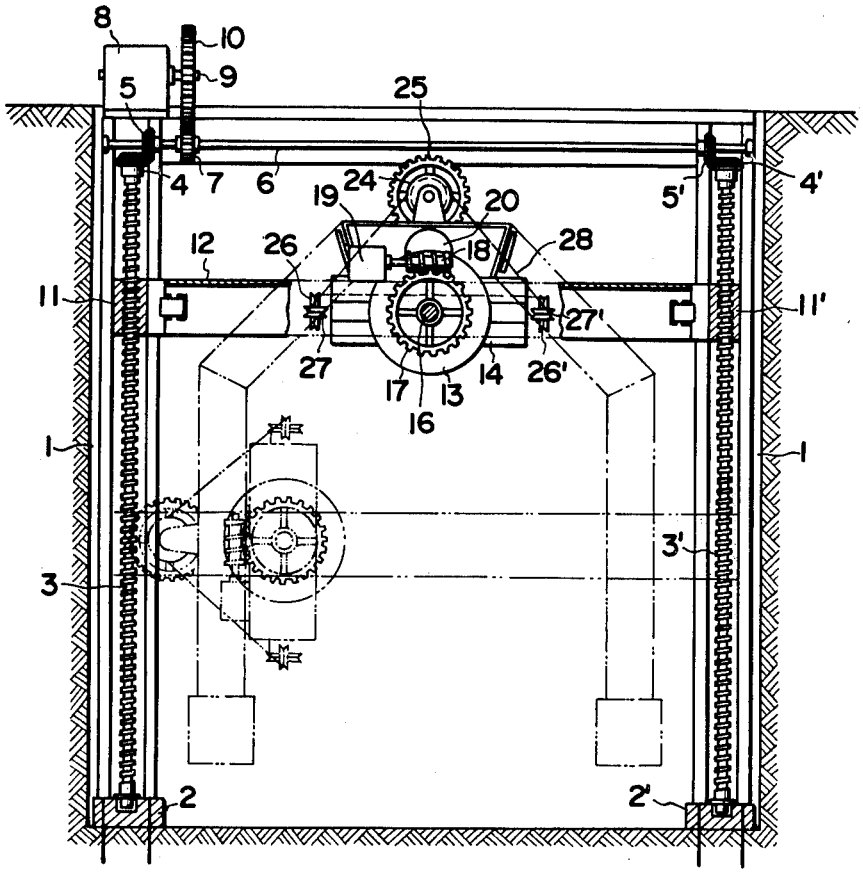
FIG. 16 is a transverse, cross-sectional view of the excavating device, taken along the line Z—Z' of FIG. 15.

Description will now be turned to the excavating operation of a tunnel according to a process of the invention by using the casing units 30, and to an excavating device of the aforesaid arrangement in conjunction with the accompanying drawings. As shown in FIG. 1, a tunnel is to be provided in the transverse direction to a railway A. Firstly, pits 1, 1' having suitable width and lengthe are provided on the longitudinally opposite sides of the tunnel to be constructed, respectively. An excavating device is placed in one of pits 1. In this respect, as shown in FIG. 15 and 16, base portions 2, 2' are provided on the bottom surface of the pit 1 on the opposite side portions thereof. Screw rods 3, 3' are rotatably supported thereon at the lower ends of the rods 3, 3'. Bevel gears 4, 4' are secured to the top ends of the rods 3, 3'. Other bevel gears 5, 5' are secured to a rotary shaft 6 in meshing relation to the bevel gears 4, 4', respectively. A gear 7 secured to the rotary shaft 6 meshes with a gear 10 secured to a rotary shaft 9 of a reversible motor 8. Internally-threaded cylinders 11, 11' are fitted or threaded on the screw rods 3, 3', while a platform-supporting beam 12 is secured to the internally-threaded cylinders 11, 11'. A rotary disc retaining body 13 is mounted on the central portion of the supporting beam 12, while a rotary disc 15 which is secured to the rear end of the platform 14 is fitted in the rotary-disc-retaining body 13. A rotary shaft 16 secured to the center portion of the rotary disc 15 extends beyond the retaining body 13 rearwards thereof. A worm wheel 17 is secured to the rotary shaft 16. Another worm gear 18 meshing with the worm wheel 17 is directly coupled to the reversible motor 19 mounted on the platform-supporting beam 12. The normal and reverse rotations of the motor 19 allow a change in direction to move, of the platform 14. A mount 21 for mounting the reversible motor 20 thereon is silidably supported on the top surface of the plarform 14 in the longitudinal direction (in the horizontal direction as viewed in FIG. 15). A coupling 22 for the screw conveyor 29 is secured to the forward end of a rotary shaft 20' of the motor 20, while a gear 23 is secured to the shaft 20' of the motor 20. Meshing with the gear 23 is gear 25 which is secured to a rotary shaft 24' of a wire winding drum 24 adapted to tow or propel the mount 21 provided for the motor 20. Pulleys 26, 26' are attached to the front, opposite sides of the mount 21, while pulleys 27, 27' are attached to the rear end of the mount 21. A wire 28 is trained around the pulleys 26, 26' 27, 27' and secured at its one end to the mount 21 and wound around the drum 24.

Figure 2:
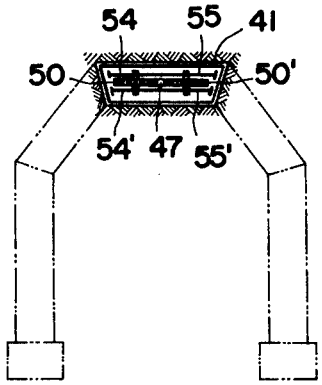
FIGS. 2 to 7 are transverse, cross-sectional views of a tunnel to be constructed, showing casing units which form a contour or the outer wall of a tunnel, particularly the process for constructing a tunnel.
Figure 3:
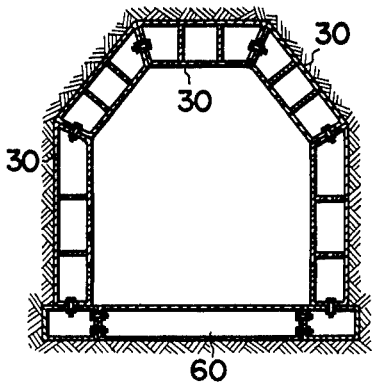
Figure 12:
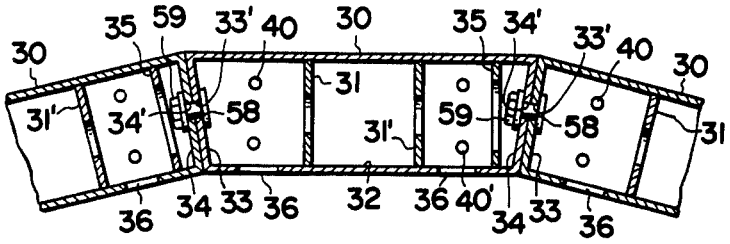
FIG. 12 is a transverse, cross-sectional view of casing units coupled together to form an outer contour or outer wall of the tunnel to be constructed.

For excavating a tunnel by means of the excavating device of the aforesaid arrangement, the screw rods 3, 3' are first rotated by means of the reversible motor 8 so as to left or lower the internally-threaded cylinders 11, 11' and hence the platform-supporting beam 12 so as to locate the platform 14 in the top position of a tunnel to be constructed, as shown in FIGS. 1 and 2. Then, the rear end of the screw conveyor 29 is secured to the coupling 22 of the rotary shaft 20' of the motor 20 supported on the mount 21, while the screw conveyor 29 is inserted into the central space 32 in the first casing unit 30. Then, the shaft 48 of the worm gear 47 for the excavator is coupled to the tip of the screw conveyor 29, and the casing unit 30 is coupled to the rear end plate 43 of the excavator body 41 by means of bolt 57 through the bolt hole 46. Then, the excavating edge 42 is positioned in opposed relation to the wall of the pit 1, which is wall to be excavated. The motor 20 is driven to rotate the screw conveyor 29, so that the worm gear 47 coupled to the tip of the conveyor 29 may be rotated. As a result, the worm wheels 50, 50' meshing therewith are rotated, so that the cutters 54, 54', 55, 55' secured to the shafts 51, 51' are rotated to excavate the sand and soil therearound, which are in turn discharged by means of the screw conveyor 29 through the central space 32 defined in the casing unit 30. When the screw conveyor 29 is rotated, the winding drum 24 is rotated through the medium of gears 23, 25 by the motor 20, so that the wire 28 is wound around the winding drum 24. As a result, the mount 21 for the motor 20, which is tied to the tip of the wire 28 leading around the pulleys 26, 26', 27, 27', may advance gradually, and as a result the excavator may go forwards, while excavating the sand and soil. When the excavator advances a given distance, then the screw conveyor 29 is disconnected from the rotary shaft 20' of the motor, and the mount 21 is retracted, after which the forward end of the succeeding screw conveyor 29 is coupled to the rear end of the preceding screw conveyor 29, while the succeeding casing unit 30 is coupled to the preceding casing unit 30 by inserting the bolts through the bolt holes 39, 39' in the end plates 37, 37' of the succeeding casing unit 30. In addition, the rear end of the screw conveyor 29 is coupled to the rotary shaft 20' of the motor 20. The above cycle of the operation is repeated until the excavator advances up to the wall of the other pit 1'. When the excavator arrives at the wall in the other pit 1', then the excavator is removed and the motor is driven in the reverse direction, so that the motor 20 along with the screw conveyor 29 may be retracted. Then, the screw conveyor 29 is removed from the rotary shaft 20' of the motor 20, while one screw conveyor is disconnected from another in turn thereafter. Then, the rotary disc 15 at the rear end of the platform 14 is rotated through the medium of worm gear 18 and worm wheel 17 by means of the motor 19 clockwise or counterclockwise as viewed in FIG. 16, so as to located the excavator in the position adjacent to a run of the casing units 30 located in the preceding cycle of excavating operation, for placing another run of casing units for the ceiling portion of a tunnel. Then, the platform 14 is rotated as shown in FIG. 16, while the internally-threaded cylinders 11, 11' as well as supporting beam 12 secured thereto are lowered due to the rotation of motor 8, for placing still another run of casing units to form the side wall of the tunnel. Upon placing another run of casing units 30 in line with the existing run of casing units 30, as shown in FIG. 12, tightening means 58 is inserted through the hole 33' provided in the side wall 33 of the existing casing unit 30 for tightening the wall (around of the hole 33') of the casing unit 30 in the existing run of casing units, to the opposed wall (above and below the slit 34') of another casing unit adjacent to the former. The excavator advances in the same manner as in the preceding cycle of operations. The tightening means 58 is tightened by a nut 59, after sand and soil have been removed from the casing units. Finally, casing units for the base portions of a tunnel on the opposite sides thereof are placed in the same manner.

The contours of casing units and excavator conform to the contour of the wall of a tunnel to be constructed. In other words, the casing units thus placed eventually form the outer wall of the tunnel. After the completion of placing the casing units along the imaginary contour of a tunnel to be constructed, sand and soil surrounded by the casing units or within the casing units themselves are removed. Then, the casing units forming the base portions of a tunnel are interconnected through the medium of a H-section steel 60 and the like, thereby forming the bottom wall of a tunnel. In this case, the respective adjoining walls of casing units are fastened together by means of bolts and nuts.

Figure 4:
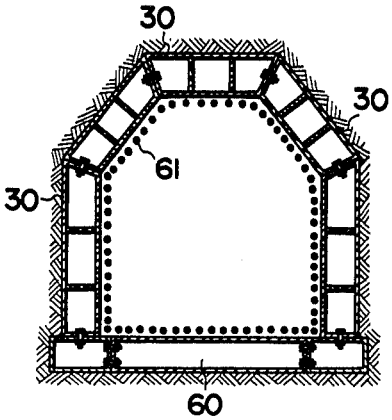
Figure 5:
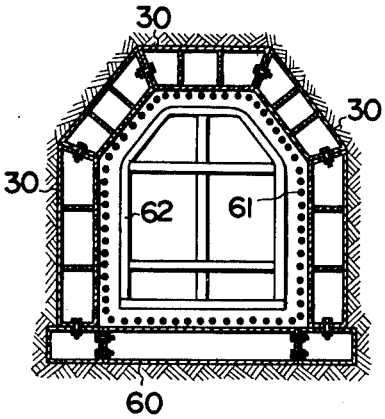
Figure 6:
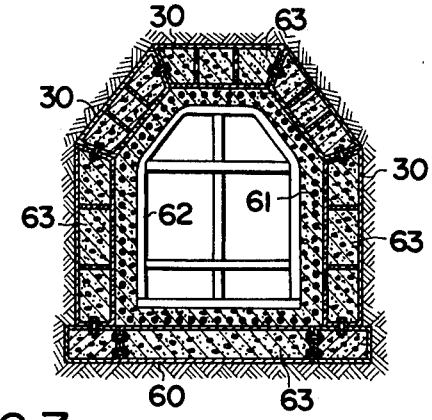
Figure 7:
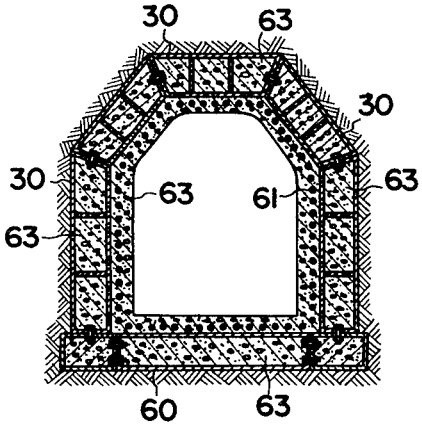
Figure 8:
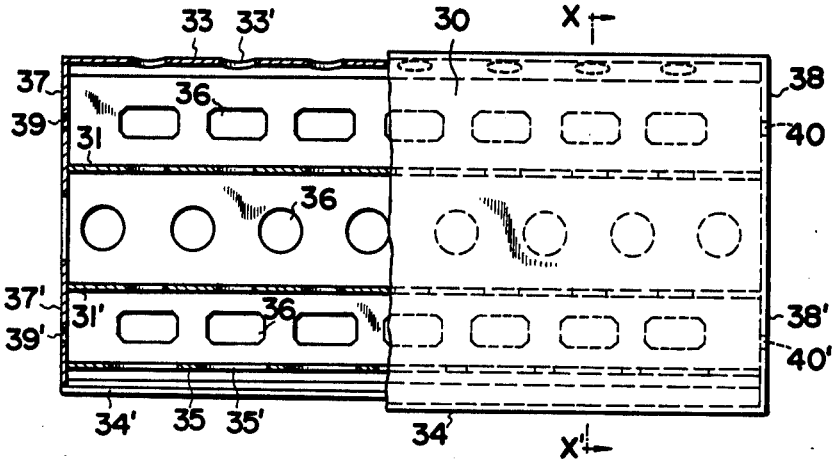
FIG. 8 is a plan view, partly broken, of a casing unit for use in the process of the invention.
Figure 9:
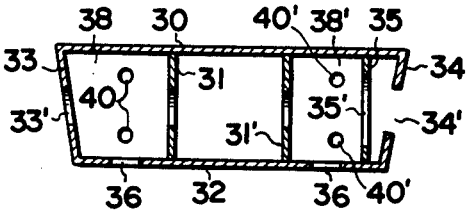
FIG. 9 is a cross-sectional view taken along the line X—X' of FIG. 8.
Figure 10:
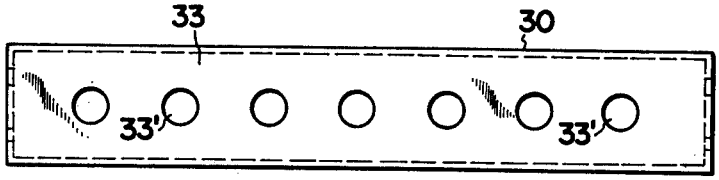
FIG. 10 is a left-hand side view of the casing unit of FIG. 9.
Figure 11:
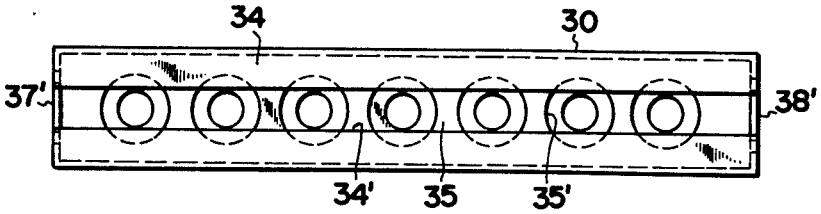
FIG. 11 is a right-hand side view of the casing unit of FIG. 9.

In this matter, sand and soil interior of the casing units forming the outer wall of a tunnel are removed, and the inside of the outer wall is cleaned. Then, as shown in FIG. 4, reinforcing steel bars 61 are placed along the inner surface of the outer wall or casing units of the tunnel, after which a mold 62 is placed inwards thereof as shown in FIG. 5. Concrete 63 is poured into a space defined between the inner surface of the outer wall and the outer surface of the mold 62, as shown in FIG. 6. Finally, the mold 62 is removed as shown in FIG. 7, thereby completing the construction of the tunnel. It is needless to mention that concrete is poured into a gap defined between the outer surface of casing units and the wall of the ground.

As is apparent from the foregoing description, there are provided a plurality of runs of box-shaped, hollow casing units extending in the longitudinal direction and covering the outer contour of the tunnel to be constructed, by coupling one casing unit to the rear of an excavator and then another casing unit to the rear end of the preceding casing unit, sequentially, so that the outer wall of the tunnel may be formed of casing units thus placed. As a result, the excavating operation may be simplified to a great extent, with desired accuracy. In addition, a tunnel of considerable length may be excavated with ease according to the process of the invention. Furthermore, the casing units thus placed are of hollow box-shape, and thus concrete may be filled therein, so that the casing units may form the outer wall of the tunnel as structural members, thereby increasing the strength of the tunnel. In addition, the rear end of a platform is rotatably attached to a supporting beam which may be moved up and down along screw rods positioned in a pit on one side, while a motor adapted to rotate the screw conveyor having an excavator at the front end thereof, and a wire-winding drum are movably mounted on the platform in the longitudinal direction. In this respect, the platform may be moved along the top, inclined and side walls of the tunnel, and casing units may be separately preformed, and coupled to the rear end of the excavator as well as to the rear end of the preceding casing unit, thereby simplifying the excavating operation. Still furthermore, a worm gear may be rotated by the screw conveyor, so that worm wheels meshing with the worm gear may be rotated so as to rotate cutters, and thus excavator may be provided which is small in size, simple in construction, and high in efficiency.

The invention may be embodied in other specific forms without departing from its spirit or essential characteristic. The above-described embodiment is, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. An excavating device for use in the construction of a tunnel, comprising:

an excavator body adapted to be mounted on a forward end of one of a plurality of box-shaped hollow casing units having shapes which conform to imaginary segments obtained by dividing the imaginary peripheral portion of a tunnel to be constructed, in both the longitudinal and transverse direction of said tunnel;

at least one pair of cutter wheel assemblies arranged in side-by-side relation and mounted on shafts which are arranged in said body at right angle against an advancing direction of the excavator body; and a driving unit for providing a synchronous rotation in said side-by-side cutter wheel assemblies.

2. The excavating device for use in the construction of a tunnel in claim 1, wherein the cutter wheel assemblies are arranged such that the rotary orbits of the leading ends of the side-by-side cutter wheels are partially overlapped with each other.

3. The excavating device for use in the construction of a tunnel in claim 1, wherein the driving device for synchronously rotating a pair of side-by-side cutter wheel assemblies includes a worm wheel mounted on each of the shafts supporting the cutter wheel in the excavator body of non-circular section, a worm commonly engaged with said worm wheel, a casing for enclosing said worm wheels and worm.

4. The excavating device for use in the construction of a tunnel in claim 1, wherein the driving device is connected to a screw conveyor and material excavated by the cutter wheel assemblies is fed out by said screw conveyor.

* * * * *

UNITED STATES PATENT AND TRADEMARK OFFICE

CERTIFICATE OF CORRECTION

PATENT NO. : 4,166,509

DATED : September 4, 1979

INVENTOR(S) : TOSHIYUKI UENO ET AL

It is certified that error appears in the above—identified patent and that said Letters Patent is hereby corrected as shown below:

Title page, beneath the line "[22] Filed: July. 6, 1978" please insert the following lines -- [30] Foreign Application Priority Data August 20, 1976 Japan.....51 098665 --.

Column 1, line 37, "excarator" should read -- excavator --;

Column 1, line 47, "alows" should read -- allows--;

Column 1, line 56, "runnel" should read -- tunnel--.

Column 3, line 43, "opposithe" should read -- opposite the --;

Column 3, line 57, "A" should read -- A --;

Column 3, line 58, "lengthe" should read -- length--.

UNITED STATES PATENT AND TRADEMARK OFFICE

CERTIFICATE OF CORRECTION

PATENT NO. : 4,166,509

DATED : September 4, 1979

INVENTOR(S) : TOSHIYUKI UENO ET AL

It is certified that error appears in the above—identified patent and that said Letters Patent is hereby corrected as shown below:

Column 4, line 18, "silidably" should read -- slidably --;

Column 4, line 19, "plarform" should read -- platform --;

Column 4, line 35, "left" should read -- lift --

Column 4, line 49, "is wall " should read -- wall is --.

Signed and Sealed this

*Twenty-third* Day of *September 1980*

[SEAL]

*Attest:*

*Attesting Officer*

SIDNEY A. DIAMOND

*Commissioner of Patents and Trademarks*